United States Patent [19]

McGuire

[11] Patent Number: 4,669,698

[45] Date of Patent: Jun. 2, 1987

[54] OUTBOARD MOTOR MOUNTING BRACKET

[76] Inventor: Michael J. McGuire, P.O. Box 1250, Milan, Ohio 44846

[21] Appl. No.: 795,213

[22] Filed: Nov. 5, 1985

[51] Int. Cl.[4] ..... F16M 1/00; B63H 21/26

[52] U.S. Cl. ..... 248/641; 248/642; 440/900

[58] Field of Search ..... 248/641, 640, 642, 643, 248/544; 440/53, 61-63, 900

[56] References Cited

U.S. PATENT DOCUMENTS

| | | | |
|---|---|---|---|
| 2,842,086 | 7/1958 | Yost | 248/641 |
| 2,928,630 | 3/1960 | Wisman | 248/641 |
| 3,075,490 | 1/1963 | Lang | 248/642 |
| 3,245,641 | 4/1966 | Hart | 248/641 |
| 3,877,667 | 4/1975 | Monckton | 248/641 |
| 4,077,353 | 3/1978 | Webb, Jr. | 248/641 |
| 4,367,860 | 1/1983 | Strang | 248/641 |
| 4,448,387 | 5/1984 | Gilbreath | 248/642 |
| 4,482,330 | 11/1984 | Cook | 440/61 |
| 4,545,559 | 10/1985 | Gilbreath | 248/642 |

*Primary Examiner*—Cornelius J. Husar
*Assistant Examiner*—Todd G. Williams
*Attorney, Agent, or Firm*—Fay, Sharpe, Beall, Fagan, Minnich & McKee

[57] ABSTRACT

A mounting bracket is provided for supporting outboard motors on boats initially designed for I/O motors. The bracket includes a central bracing member, interposed between side members, that also functions as a template or jig whereby the bracket is accurately aligned with a boat transom. The members of the bracket are cast of an aluminum magnesium alloy to inhibit corrosion problems prevalent in prior art designs. Additionally, the bracket is sufficiently lightweight to provide better performance characteristics of the boat.

16 Claims, 4 Drawing Figures

OUTBOARD MOTOR MOUNTING BRACKET

BACKGROUND OF THE INVENTION

This invention pertains to the art of outboard motors and, more particularly, to brackets for mounting the outboard motors to a boat. The invention is particularly applicable to boats having a transom for mounting the bracket and will be described with particular reference thereto. However, it will be appreciated that the invention has broader applications and may be advantageously employed in other boating environments and applications.

In the past, large boats ranging from 20–30 feet in length, were generally limited to inboard-outboard or I/O motors. Such a construction indicates that the motor is mounted in the boat while the drive is extended exteriorally thereof. A 21 foot boat was commonly regarded as the largest manufactured outboard type boat whereas the range from 21–31 feet normally required an I/0-type structure. The I/O motor is extremely heavy as well as taking up a great deal of interior space. The I/O motor is also limited in performance due to both its weight versus horsepower and location of the propeller relative to the boat hull.

Initial conversions of these boats to an outboard type arrangement utilized a cut-out formed in the transom of the boat. The cut-out, though, limited the use of the boat in rough water since the boat was subject to possible swamping. In an effort to overcome swamping in the converted boats, motor wells were built along the rear of the boat. The motor wells created unusable space in the boat with their bulky structure.

Later conversions of the I/O boats to an outboard-type arrangement included crudely formed structures or brackets. This type of outboard mounting provided greater interior space for storage and equipment, as well as removing 800–1,000 lbs. of weight from the boat in contrast to an unconverted I/O boat. The propeller is moved approximately 2 feet to the stern through use of the bracket allowing a smoother flow of water. The leverage on the boat and boat performance are increased.

By way of example, a typical I/O motor may weigh 1,000–1,200 lbs. while attaining a top speed of 26 mph. On the other hand, a prior art bracket assembly included a motor weighing approximately 350–400 lbs., a bracket weighing about 90 lbs., with a top speed of 37–38 mph. More particularly, the bracket was constructed of steel tubing which is epoxy coated. Even though the steel tubing is usually coated with epoxy it still has the drawback of corroding if the external surface becomes scratched or dented.

Various advantages are realized through use of an outboard motor mounted by means of such a bracket. With the propeller further behind the boat, the engine itself may be mounted higher to decrease the drag of the engine. In addition, a stablizing effect on the boat is created due to the rearward mounting of the propeller. The additional leverage gives a response at full throttle, as well as allowing the boat to plane at a much lower speed range due to the weight reduction. The boat operator can readily see over the bow and handling of the boat is improved.

It has been considered desirable to overcome the above deficiencies while retaining the noted benefits, as well as providing an outboard mounting bracket of lower weight, lower cost, easy to install, and formed of a non-corrosive material. The subject invention is deemed to economically meet these needs and others.

SUMMARY OF THE INVENTION

In accordance with the subject invention, and outboard mounting bracket is provided for supporting a motor in spaced relation to a boat transom. First and second support members include transom mounting surfaces and motor mounting surfaces. The first and second support members are mounted to the associated transom in generally parallel spaced relation with a third support member operatively interconnecting the first and second support members. The third support member has a configuration associated with a preselected fastening means pattern which forms a template for accurately arranging the fastening means.

In accordance with a further aspect of the invention, the support members are formed of a corrosion-resistant material.

In accordance with a still further aspect of the invention, the first and second support members include a means for deflecting water away from the engine.

In accordance with a still futher aspect of the invention, the third support member is mounted along an area approximately mid-height on the first and second support members generally forming an H configuration.

In accordance with the method of the subject invention, the first and second support members, fastener means, and an interconnecting bracing member are supplied. The bracing member is aligned with the boat transom and the bracing member used as a template for forming appertures in a preselected pattern in the associated transom. The first and second support members are fastened to the transom and lastly, the bracing member is fastened to the first and second support members.

In accordance with another aspect of the method, the bracing member is temporarily mounted to the transom and later removed therefrom and a seal is provided between the associated transom and support members.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment and method which will be described in detail in this specification and illustrated in the accompanying drawings which form a part hereof and wherein.

DETAILED DESCRIPTION OF THE PREFERRED EMBODIMENT AND METHOD

Figure 1:
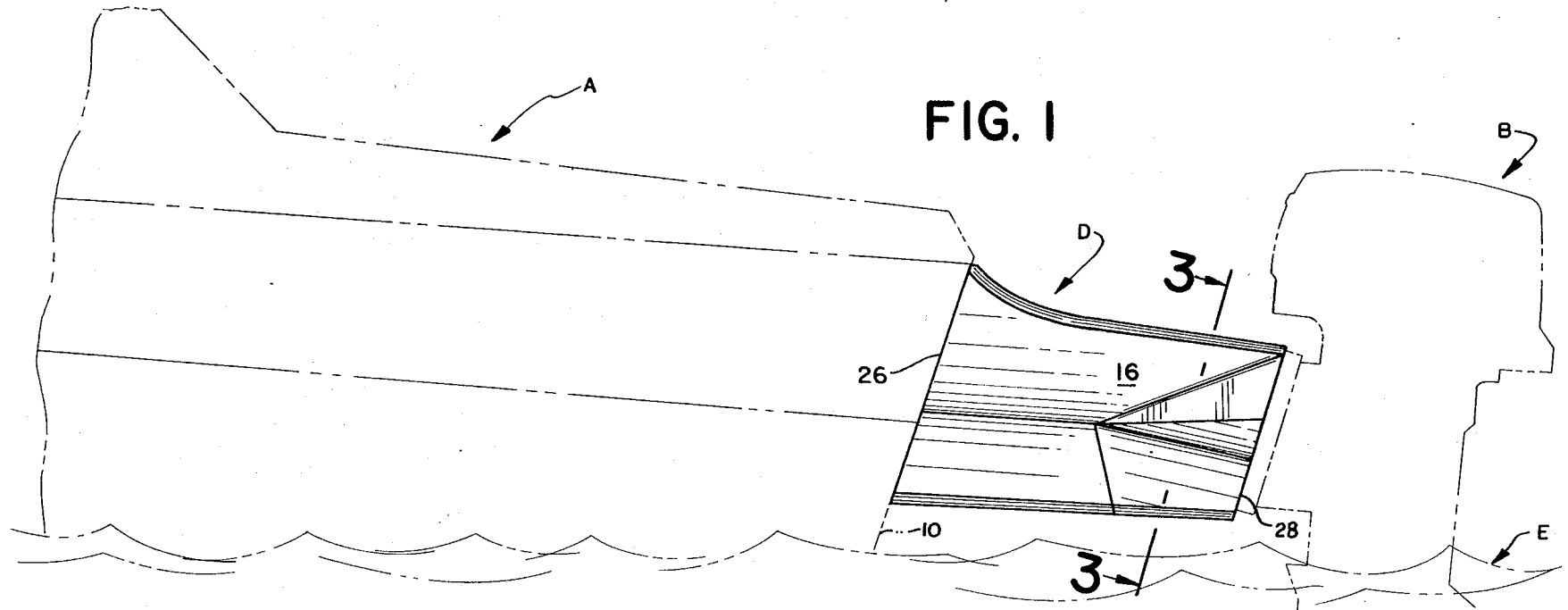
FIG. 1 is a side view of a boat hull stern with an outboard motor mounted thereto through use of the subject invention.

Referring now to the drawings wherein the showings are for purposes of illustrating the preferred embodiment and method of the invention only and not for purposes of limiting same, FIG. 1 generally illustrates mounting an outboard motor on a boat transom through use of the subject invention. A boat A is conventionally propelled through the water through use of an internal combustion motor B. The hull of the boat displaces a predetermined amount of water depending on its own dead weight. The motor B, whether mounted inboard or outboard, includes a propeller C extending outward from the boat which rotates at high speeds to propel the boat through the water in a conventional, well known manner.

The subject invention is directed to a mounting bracket D that fixedly mounts an outboard type motor B to a rear transom 10 of the boat. The transom extends along the stern of the boat and may extend out of the water E at a predetermined angle.

Figure 2:
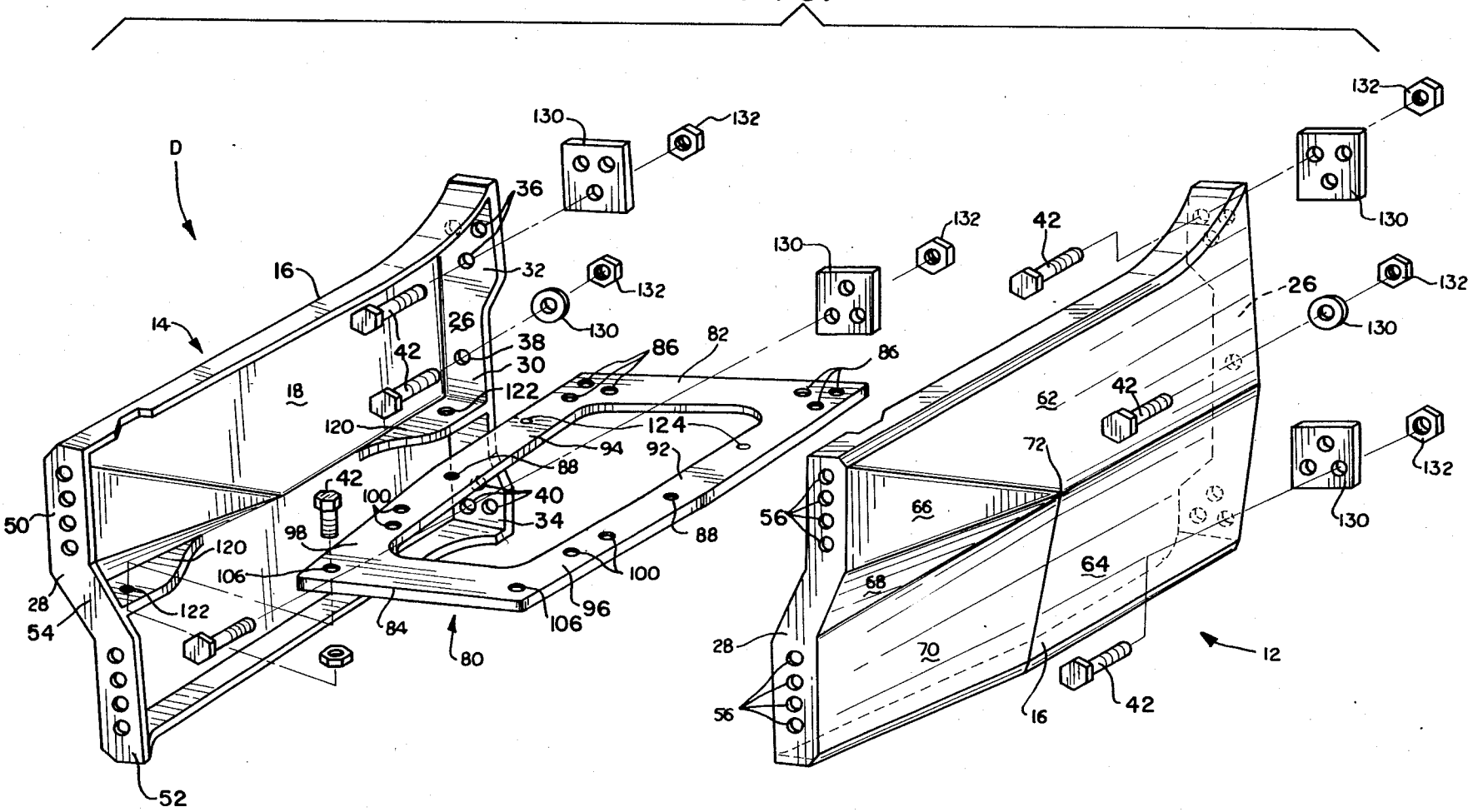
FIG. 2 is an exploded perspective view of the subject invention.

With particular reference to FIG. 2, the subject invention will be described in greater detail. A pair of support members or right and left side panels 12, 14 extend generally outwardly from the transom 10. The construction of the right panel 12 and the left panel 14 is substantially the same, one panel being the mirror image of the other so that description of one panel 12 is applicable to the other panel 14 unless noted otherwise. For ease of illustration, like elements of one panel are identified by like numerals in the other panel and different elements are identified by different numerals. The side panels 12, 14 are of generally elongated structure having an exterior surface 16 and interior surface 18 of generally planar conformation. The exterior surface 16 extends from a first flange or transom mounting surface 26 to a second flange or motor mounting surface 28.

The transom mounting surface 26 extends generally perpendicular to the exterior surface 16 in facing inward relation with the other side panel. The transom mounting surface is of varied width having an intermediate narrowed portion 30 disposed between upper and lower portions 32, 34. The upper portion includes a plurality of apertures 36 formed therethrough, three apertures being used in the preferred embodiment. A single aperture 38 is formed in the intermediate portion 30, while the lower portion 34 also has at least three apertures 40 formed therethrough. The apertures receive fastening means such as bolts 42 for securely mounting the right and left panels to the transom 10 along their transom mounting surfaces 26 as will be described further hereinbelow. Only three bolts 42 are shown for receipt in the transom mounting surfaces for ease of illustration.

The motor mounting surface 28 includes an upper portion 50, lower portion 52 in parallel spaced relation therefrom, and an angular interconnecting portion 54 extending between the upper and lower portions. The right and left panels, in assembled relation, define a motor mounting surface dimension of greater upper width than the lower portion dimension. In addition, the upper portion 50 and lower portion 52 each include plural apertures 56 for mounting an outboard motor to the motor mounting surface 28. The apertures are vertically arranged at a predetermined spacing whereby the outboard motor may be adjustably mounted at various heights relative to the mounting bracket D. For example, the apertures 56 may be spaced approximately one inch apart so that four mounting bolts extending from the outboard motor mounting plate for respective engagement with the upper and lower aperture mounting pairs of respective panels, allow the motor to be selectively mounted to the bracket at four respective heights.

As briefly described above, and particularly shown in FIGS. 2 and 3, the exterior surface 16 of the respective panels is of generally planar construction. More specifically, the exterior surface includes a plurality of planar portions 62, 64, 66, 68, 70. A vertex 72 is defined at approximately the midpoint of the exterior surface where the various planar portions which comprise the overall exterior panel structure interconnect. More specifically, the exterior surface first and second portions 62, 64 extend rearwardly from the transom mounting surface toward the motor mounting surface at the rear edge of the bracket. The third portion 66 is triangularly shaped, as is portion 68, and angularly disposed with respect to the first portion 62. The fourth triangular portion 68 is angularly disposed with respect to both the upper third portion 66 and lower fifth portion 70 defining a narrowing region that coincides with the angular portion 54 of the motor mounting surface. The angular disposition of the third, fourth, and fifth portions define a means for deflecting waves and water spray away from the mounted outboard motor.

A third support member or bracing member 80 serves a dual function in the subject invention. As illustrated in FIG. 2, the bracing member is horizontally disposed in interconnecting relation with the vertically disposed right and left panels 12, 14. The bracing member is of generally ring-shaped conformation having first and second ends 82, 84. The first or upper end 82, includes plural apertures 86, set off in groups of three at respective corners of the bracing member. The apertures 86 are arranged in the same pattern as the upper apertures 36 defined in the transom mounting surface. The width between the aperture groups along the first or upper end of the bracing member, defines the final distance between the mounted right and left panels as will be apparent from the further discussion below. A pair of apertures 88 is centrally disposed on generally parallel central connecting portions 92, 94. Additionally, two groups of apertures 100, each group including a pair of apertures, are disposed along tapering portions 96, 98. The tapering portions extend from the central connecting portions 96, 98 to the second end 84. Additional corner apertures 106 are provided along the lower end 84 of the bracing member.

A pair of reinforcing members or gussets 120 are provided along the interior surface 18 of the right and left panels. The gussets 120 are disposed along the interior surface between the transom mounting surface 26 and the motor mounting surface 28. The gussets provide further support along an area disposed between the transom and motor mounting surfaces for the generally perpendicular arrangement between these members. Apertures 122 are provided through the gussets for alignment with the bolts 42 and selected ones of apertures 86, 106 in the corners of bracing member 80.

In the preferred embodiment illustrated in FIG. 2, four bolts are utilized, one bolt in each respective corner of the bracing member. In this manner, the left and right panels along with the bracing member 80 form an H-shaped configuration that is supported against laterally imposed loads. Any force exerted generally normal to the exterior surfaces 16 of the side panels is transferred by means of the bracing member 80 to the other side panel. In addition, the mid-height mounting arrangement of the bracing member with respect to the right and left panels prevents the side panels from collapsing.

Figure 4:
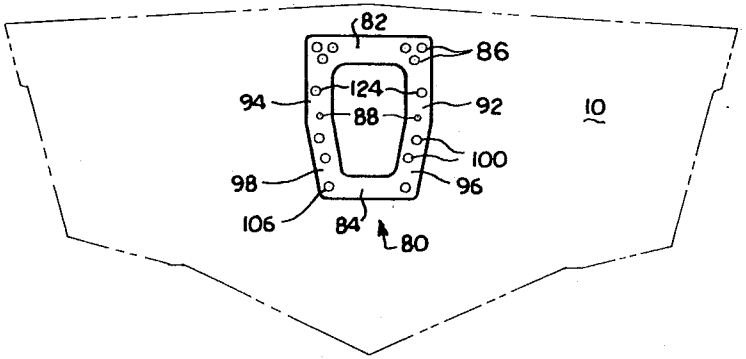

The second function of bracing member 80 is particularly illustrated in FIG. 4. The bracing member is also utilized as a template to assure alignment of the apertures formed in the boat transom 10 with the apertures formed in the transom mounting surface 26. Another pair of centrally disposed apertures 124 is provided in the bracing member for temporarily mounting the bracing member 80 in planar relation with the boat transom 10 for use as a template or jig.

A pair of holes is drilled in the transom after predetermined measuring of the transom with respect to the keel. Screws are placed through the apertures 124 into the transom for temporary mounting of the template. The apertures 86, 88, and 100 are used for drilling similar holes in the transom. The thickness of the bracing member is sufficient to serve as a means for holding drill bushing which guide the drill bit whereby the holes are accurately formed. Once the necessary apertures have been drilled into the transom, the bolts are removed from the apertures 124 and the bracing member removed from the transom. The transom mounting surfaces 26 of the right and left panels are thereafter aligned with the drilled holes in the transom.

A sealing member or coating may be provided on the transom whereinafter the right and left panels are secured to the transom through use of the bolts 42. The outer end of the bolts 42 cooperate with backing plates and washers 130 and nut numbers 132 for securely fastening the right and left panels to the transom and increasing the support area. The right and left panels, thereby, assume a generally perpendicular orientation with the transom and are, in turn, in parallel spaced relation with one another.

The bracing member 80 is next placed into abutting relation with the gussets 120 along its respective corners and bolts 42 are passed through the aligned apertures for fixedly retaining the bracing member to the right and left panels. Once the bolts have been securely fastened, the mounting bracket D is adapted for receiving the outboard motor along the motor mounting surface 28.

The mounting bracket D is sand-cast of an aluminum magnesium alloy. This alloy is extremely resistant to corrosion since it is low in both copper and iron as well as lightweight. Typically, the overall weight of the subject new bracket is approximately 40 lbs. The bracket may also be covered with an epoxy material which adds further corrosion protection. The various apertures in the mounting bracket pieces, are cored so that no drilling of the side panels is required. In addition, where high accuracy is required, such as in the bracing member apertures, the apertures may be drilled after the casting process. The apertures in the corners of right and left side panels are arranged in a three bolt pattern to minimize the bolts from loosening from the transom. The triangular arrangement allows support of greater weight and prevents the bolts from loosening.

Figure 3:
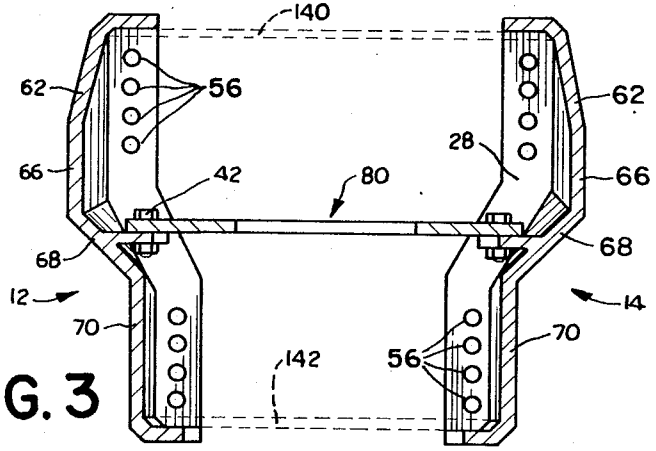
FIG. 3 is a cross sectional view along the lines 3—3 of FIG. 1 through the bracket illustrating additional bracing members in phantom; and, FIG. 4 is an end elevational view illustrating use of the bracing member as a template on the boat transom shown in phantom.

With reference to FIG. 3, a pair of additional support members or bracing members, 140, 142 are illustrated in phantom. It will be understood that either one, or both, of the additional bracing members 140, 142 may be used in conjunction with bracing member 80. Moreover, the additional bracing members can be provided with the necessary apertures for use as a template if the bracing member 80 is omitted.

According to the method of the subject invention, the transom of the boat is closely measured to determine the motor centerline. If only a single outboard motor is being mounted, the bracing member 80 is placed on the transom 10 as illustrated in FIG. 4. As described above, the bracing member is temporarily mounted so that the fastener receiving apertures may be formed in the boat transom. The bracing member is thereafter removed, and the transom surface coated with a sealing material. The right and left mounting bracket panels 12, 14 are thereafter secured to the transom through use of the fastening means as described above. The bracing member is then placed in abutting relation with the gussets 120 and the fastening means 42 passed therethrough. A secure, H-shaped configuration is thereby formed.

The invention has been described with reference to the preferred embodiment and method. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. An outboard mounting bracket adapted for supporting a motor in spaced relation with an associated boat transom comprising:

a first support member having a transom mounting surface and a motor mounting surface;

a second support member having a transom mounting surface and a motor mounting surface, said first and second support members mounted to the associated transom in generally parallel spaced relation;

means for fastening said first and second support members to the associated transom, said fastening means arranged in a preselected fastening pattern; and, a third support member operatively interconnecting said first and second support members along an area approximately mid-height on said first and second support members, said third support member having a configuration associated with said preselected pattern which forms a template for arranging said fastening means in said preselected pattern.

2. An outboard mounting bracket adapted for supporting a motor in spaced relation with an associated boat transom comprising:

a first support member having a transom mounting surface and a motor mounting surface;

a second support member having a transom mounting surface and a motor mounting surface, said first and second support members mounted to the associated transom in generally parallel spaced relation;

means for fastening said first and second support members to the associated transom, said fastening means arranged in a preselected fastening pattern;

a third support member operatively interconnecting said first and second support members, said third support member having a configuration associated with said preselected pattern which forms a template for arranging said fastening means in said preselected pattern; and, each of said first and second support members is generally planar along an exterior surface extending from said transom mounting surface to said motor mounting surface, said generally planar exterior surface including means for deflecting water, said deflecting means disposed adjacent said second motor mounting surfaces.

3. An outboard mounting bracket adapted for supporting a motor in spaced relation with an associated boat transom comprising:

a first support member having a transom mounting surface and a motor mounting surface;

a second support member having a transom mounting surface and a motor mounting surface, said first and second support members mounted to the associated transom in generally parallel spaced relation;

means for fastening said first and second support members to the associated transom, said fastening means arranged in a preselected fastening pattern;

a third support member operatively interconnecting said first and second support members, said third support member having a configuration associated with said preselected pattern which forms a template for arranging said fastening means in said preselected pattern and, said first and second support members including mounting flanges operatively engaging said third support member along an area interposed between said transom mounting surfaces and said motor mounting surfaces.

4. The outboard mounting bracket as defined in claim 3 wherein said first, second, and third support members are formed of a corrosion resistant material.

5. The outboard mounting bracket as defined in claim 4 wherein said corrosion resistant material is cast from an aluminum magnesium alloy.

6. The outboard mounting bracket as defined in claim 3 wherein said first and second support members have a generally planar face, said transom mounting surface and said motor mounting surface generally perpendicular to said generally planar face, and said mounting flanges reinforcing said perpendicularly disposed surfaces.

7. The outboard mounting bracket as defined in claim 3 wherein said motor mounting surfaces include means for adjusting the mounted location of said motor relative to the bracket.

8. The outboard mounting bracket as defined in claim 3 further comprising a fourth support member operatively interconnecting said first and second support members.

9. The outboard mounting bracket as defined in claim 8 further comprising a fifth support member operatively interconnecting said first and second support members.

10. An outboard mounting bracket for supporting a motor in spaced relation with an associated boat transom comprising:

a pair of elongated support members extending generally outward in substantially parallel relation from the associated transom, each support member including a transom mounting surface at one end engaging the associated transom and motor mounting surface at the other end;

means for deflecting water disposed on said support members, said deflecting means positioned adjacent said motor mounting surfaces;

means for fastening said first and second support members to the associated transom in a preselected manner; and, a bracing member interconnecting said first and second support members and generally forming an H-shaped configuration, said bracing member having a preselected conformation, said preselected conformation which serves as a template for accurately mounting said support members to the associated transom in said preselected manner.

11. The outboard mounting bracket as defined in claim 10 wherein said support members include generally planar exterior surfaces extending between end flange portions normally disposed to said exterior surfaces, said flange portions forming said transom mounting and motor mounting surfaces, a pair of gussets formed on each support member for strengthening said flange portions, said gussets further providing areas for laterally joining said bracing member to said support members whereby the mounting bracket is reinforced against laterally imposed forces.

12. The outboard mounting bracket as defined in claim 10 wherein said deflecting means includes first and second generally planar surfaces forming a portion of an exterior surface on each of said support members, said first and second planar surfaces disposed in generally diverting relation.

13. A method of mounting an outboard motor to an associated boat transom, comprising the steps of:

supplying first and second support members, fastener means, and an interconnecting bracing member;

aligning said bracing member with the associated boat transom;

using said bracing member as a template for forming fastener receiving means in a preselected pattern in the associated transom;

fastening said first and second support members to the associated transom in accordance with said preselected pattern; and, fastening said bracing member to said first and second support members.

14. The mounting method as defined in claim 13 further including the step of providing a seal between the associated transom and said support members.

15. The mounting method as defined in claim 13 further including temporarily mounting said bracing member to the associated transom prior to said using step.

16. The mounting method as defined in claim 13 further including removing said bracing member from the associated transom subsequent to said using step.

* * * * *